US005457899A

United States Patent [19]

Chemello

[11] Patent Number: 5,457,899

[45] Date of Patent: Oct. 17, 1995

[54] ALPINE SKI BOOT WITH ADJUSTABLE UPPER

[75] Inventor: Jean-Pierre Chemello, Annecy-le-Vieux, France

[73] Assignee: Salomon S.A., Annecy, France

[21] Appl. No.: 102,242

[22] Filed: Aug. 5, 1993

[30] Foreign Application Priority Data

Aug. 11, 1992 [FR] France ..... 92 10019

[51] Int. Cl.[6] ..... A43B 5/04; A43B 5/16

[52] U.S. Cl. ..... 36/120; 36/121

[58] Field of Search ..... 36/117, 118, 119, 36/120, 121

[56] References Cited

U.S. PATENT DOCUMENTS

| | | | |
|---|---|---|---|
| 4,379,370 | 4/1983 | Balbinot | 36/121 |
| 4,455,769 | 6/1984 | Fritsch | 36/121 |
| 4,539,764 | 9/1985 | Pradier | 36/121 |
| 4,928,406 | 5/1990 | Montfort | 36/121 X |
| 5,259,127 | 11/1993 | Pallatin | 36/121 X |

FOREIGN PATENT DOCUMENTS

| | | | |
|---|---|---|---|
| 248149 | of 0000 | European Pat. Off. . | |
| 0085026 | 8/1983 | European Pat. Off. | 36/118 |
| 2647649 | of 0000 | France . | |
| 549970 | of 0000 | Germany . | |

OTHER PUBLICATIONS

EPO Search Report of FR 91 10019.

*Primary Examiner*—Paul T. Sewell
*Assistant Examiner*—BethAnne C. Cicconi
*Attorney, Agent, or Firm*—Pollock, Vande Sande & Priddy

[57] ABSTRACT

Alpine ski boot comprising a shell base (5) surmounted by an upper (2) made of one or several parts (3,4) which pivots at least partially from back to front. The boot comprises a device (35) for releasably locking the shell base (5), which device consists of a stop (13) on the shell base and a pivoting lever (11) forming a rocker device jointed to a pin (12) arranged on the rear portion (4) of the upper (2) and capable of locking the upper by cooperating with the stop (13) when acted upon by a control device (10) accessible from the outside of the boot. The locking position of this device corresponds to an initial adjustable forward extension position from which the upper (2) can pivot angularly in relation to the shell base (5). The initial forward extension position of the upper (2) can be adjusted by an arrangement (40) capable of modifying vertically the position of the hinge pin (12) belonging to the rocker device (11) relative to the front portion (4) of the upper (2) which supports it, between at least two adjustment values.

11 Claims, 5 Drawing Sheets

ALPINE SKI BOOT WITH ADJUSTABLE UPPER

FIELD OF THE INVENTION

The present invention relates to an alpine ski boot comprising a shell base surmounted by an upper incorporating a front and a rear part made from one or more pieces, the rear portion of the upper being pivotable, at least partially, from back to front and/or front to back and comprising a device for releasably locking the upper in relation to the shell base, constituted by an abutment zone on the shell base and by a pivoting lever forming a rocker device and jointed to a horizontal pin arranged on the rear portion of the upper perpendicularly to its vertical median plane and capable of cooperating with the stop to effect locking when acted upon by a control device accessible from the outside of the boot and operating counter to a return spring associated with the lever.

BACKGROUND OF THE INVENTION

In this type of boot, the initial position of the locking lever corresponds to an initial adjustable forward-extension reference position, from which the upper can pivot angularly in relation to the shell base by a predetermined amplitude.

To this end, European Patent Application No. 0 286 586 discloses forward extension-adjustment means consisting in positioning an adjustable linkage device between a rear portion of the upper and an intermediate swivelling cover carrying, moreover, the rocker which, in its turn, cooperates with the shell base, in accordance with the aforementioned criteria.

This device complicates the manufacture of the boot, since it requires the use of an additional element, i.e., the pivoting cover.

French Patent Application No. 2 647 649 attempts to solve this problem by proposing a solution involving forward extension adjustment, by making either the length of the rocker arm or the relative position of the stop variable.

This, however, requires the production of additional parts and, in consequence, extends the time required for boot-assembly.

In other words, while this last-mentioned device solves one problem, it creates another.

Furthermore, when the length of the rocker arm is made variable, its reliability in the locked position becomes uncertain, given that it bears extremely strong compression/buckling forces.

SUMMARY OF THE INVENTION

The object of the present invention is to solve these difficulties by proposing means for adjusting the forward extension of the upper which do not form part of the structure of the latter while preserving at the same time a simple, stationary shell-base abutment and an unmodified, proven one-piece rocker that can withstand over time the stresses applied to it.

To this end, the invention concerns a boot of the aforementioned type, in which the initial forward extension position of the upper is adjusted by means capable of modifying vertically the position of the hinge pin of the rocker in relation to the front portion of the upper supporting it, according to at least two adjustment values.

The means for adjusting the position of the hinge pin of the rocker are constituted by two symmetrical elements housed in corresponding stationary recesses provided, respectively, on either side of the inner and outer faces of the rear portion of the upper, these elements supporting the ends of the aforementioned hinge pin in areas which are offset radially in relation to their virtual stationary center, which merges with that of their respective recesses, so that rotation of these elements around this virtual center causes modification of the vertical position of the pin in relation to the virtual center, and thus of the upper.

BRIEF DESCRIPTION OF THE DRAWINGS

Understanding of the invention will be enhanced and other invention features will emerge from the following description, provided with reference to the attached schematic drawings illustrating, by way of example, several embodiments of the invention.

BRIEF DESCRIPTION OF THE PREFERRED EMBODIMENTS

Figure 1:
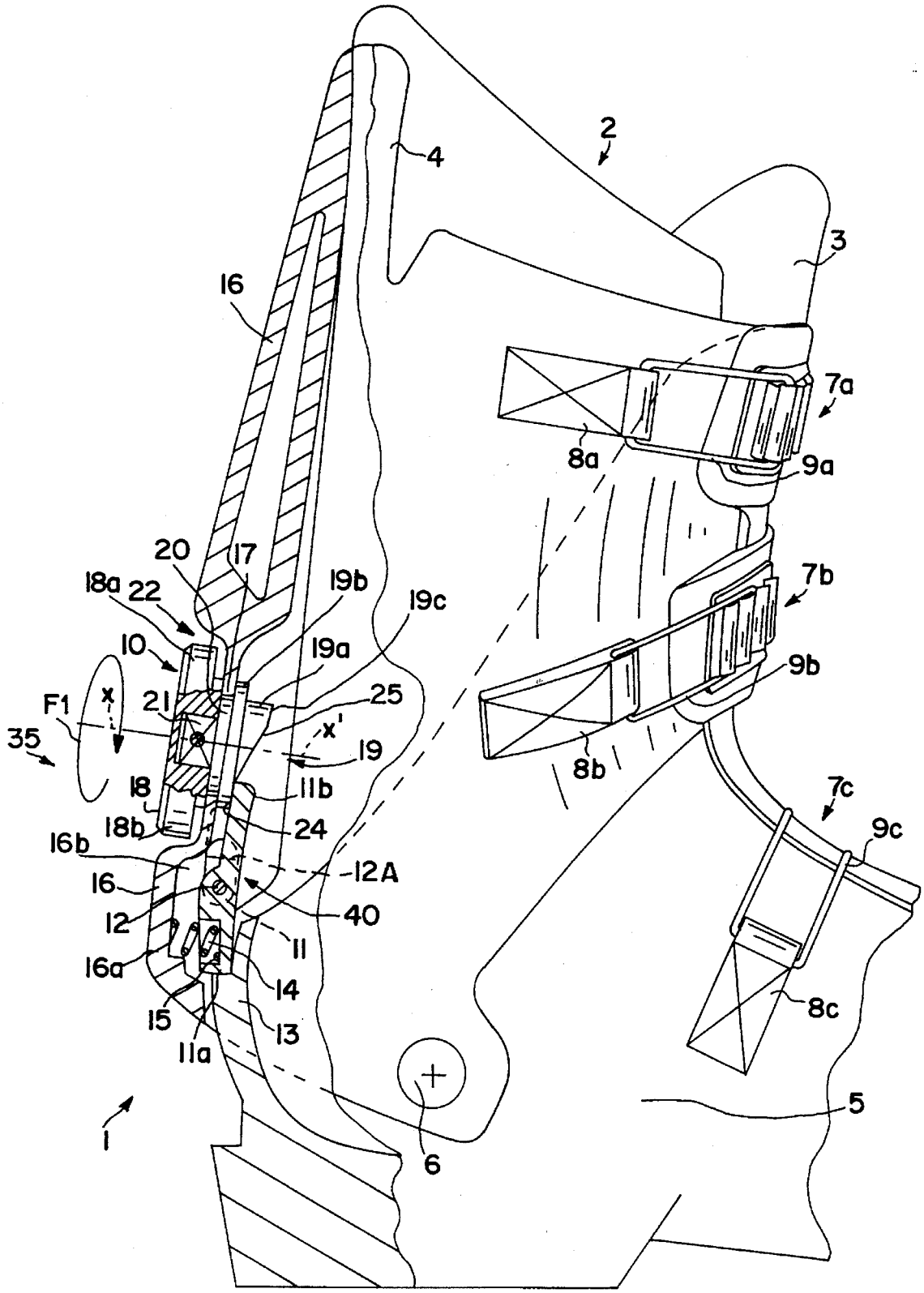
FIG. 1 is a side view of a ski boot of which one portion, shown in cross-section, shows means according to the invention for adjusting the forward extension of the upper, illustrated in the locked position.

As an shown example, the boot 1 illustrated in FIG. 1 is a "mixed entry" boot.

In accordance with the invention, the ski boot 1 comprises an upper 2 having a front portion 3 and a rear portion or rear cover 4, and a shell base 5 to which the rear portion 4 of the upper 21 is connected by rivets 6, the front portion 3 of the upper 2 being constituted by an extension of the shell base 5.

A three-point system 7*a*, 7*b*, 7*c* for tightening and closing the upper 2 over the skier's lower leg comprises, in conventional fashion, three separate tension levers 8*a*, 8*b*, 8*c* which secure under tension traction elements such as cable loops 9*a*, 9*b*, 9*c* partially enclosing the front portion of the upper 2 so as to be placed under tension by these tension levers 8*a*, 8*b*, 8*c*, of which levers 8*a* and 8*b* are fastened, for example to the lateral wings of rear cover 4, and lever 8*c*, to the rear portion of the boot.

According to the embodiment illustrated in FIG. 1, the boot 1 is provided with a device 35 for immobilizing the upper 2, functioning solely in the front-to-back direction. This immobilization device incorporates a control device 10 acting on a lever 11 pivoting around a transverse pin 12 secured in the rear part of the upper 2. The lever 11 pivots between two positions, i.e., one in which a lower end portion 11*a* of the lever 11 abuts against a rear stop 13 on the shell base 5 in the heel area, thus giving a position inclined toward the front of the upper corresponding to an active skiing position; and the other position, in which this lower portion 11*a* is released from the rear stop 13 on the shell base 5 so as to free the upper from any angled positioning constraint, the rotating control device 10 then acting on another part 11*b* opposite the end 11*a* of the pivoting lever in opposition to an elastic device 14, which is positioned in a recess 15 in the lower portion 11*a* of the lever 11 and which acts in reaction against a lower portion 16*a* of a stiffening brace 16 constituting the wall of the rear cover 4 of the upper 2. The pin 12 belonging to the lever 11 is mounted in and between the walls 16*b* of the stiffening brace 16. The rotating control device 10 can turn in a coaxial recess 17 forming a bearing in the rear portion 4 of the upper 2, and in which the aforementioned rotating device 10 is secured while being free to rotate, independently of the pivoting lever. To this end, the rotating device 10 comprise respectively, arranged on either side of the wall of the brace 16, an outer gripping part 18 that can be actuated manually in rotation, and an inner part 19 acting by means of a cam 19*a* on portion 11*b* of the pivoting lever 11, which, in fact, constitutes the cam-sensing device, the two parts 18 and 19 being connected by means of a cylindrical bearing 20 housed in the bearing 17 set in the upper 2.

According to the present embodiment, the cam 19*a* is constituted by the front end itself of the inner part 19 of the rotating control device 10, and it acts on the end 11*b* of the lever 11 opposite its lower end 11*a*, between which ends 11*a*, 11*b* the transverse pin 12 is located.

The front cam 19*a* of the control device 10 is preferably hollow, i.e., comparable to the end of a tube, and is constituted by an inclined plane forming a sloping surface, whose peripheral area is in continuous contact with one of the ends 11*b* of the pivoting lever 11. This cam has a low point 24 and a high point 25 which correspond, respectively, to a position of immobilization in the front-to-back direction, or, conversely, to a position of angular freedom of the cam, for a particular angular rotation in one direction or the other imparted to the gripping part 18 of the rotating control device 10.

Also in the present example, the gripping part 18 of the rotating control device 10 is constituted by a wheel whose blades 18*a*, 18*b* are arranged radially in relation to the longitudinal axis X–X' of said device 10 and form a plane angle between them.

Of course, this gripping part 18 of the control device may have any other shape; e.g., it may be generally circular and drum-like in shape. In any event, the gripping part 18 of the control device 10 is rigidly connected to its cylindrical shaft 20, for example by means of a driving square 21. It must be observed that the gripping part 18 of the rotating control device 10 generates a volume of revolution substantially corresponding to that of a recess 22 provided in the upper 2, in which is housed the aforementioned gripping part 18, which remains in a single plane without misalignment in relation to the outer wall of the upper 2, whatever the relative position of the cam 19*a* in relation to the pivoting lever 11.

Position-retention of the rotating control device 10 on the wall 16*a* of the upper, this wall forming here a portion of the stiffening brace 16, is ensured by clamping this wall between the gripping component 18 and a circular shoulder 19*b* of the inner part 19 forming the cam 19*a*.

In addition, the cam 19*a* comprises, in its uppermost portion, a bowl-shaped position-retention zone 19*c* corresponding to the high point of release, on which the corresponding end 11*b* of the lever 11 is positioned, in order to provide a stable release position. This position is obtained by simple rotation in the direction F1 around the axis X–X' exerted on the blades 18*a*, 18*b* of the gripping component 18.

The rotation of the cam 19*a* thus generated then drives the end 11*b* of the lever 11 in angled motion around its pin 12 in accordance with values such that the difference in height between the low point 24 of the inclined surface and its upper point 25 corresponds at a minimum to a pivoting angle of the lever 11 allowing its lower part 11 to be released from the stop 13, in order to adopt a release position capable of freeing the angular pivoting of the rear portion 4 of the upper 2.

Figure 2:
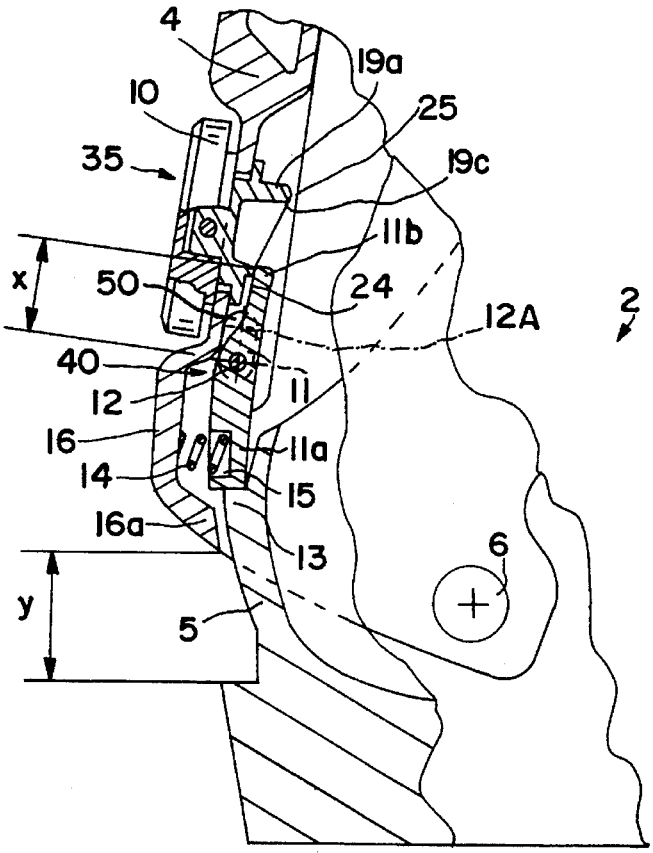
FIGS. 2 and 3 are cross-sections in partial side view of the boot illustrating the maximum and minimum forward extension positions, respectively, according to a first embodiment of means for adjusting to these positions.
Figure 3:
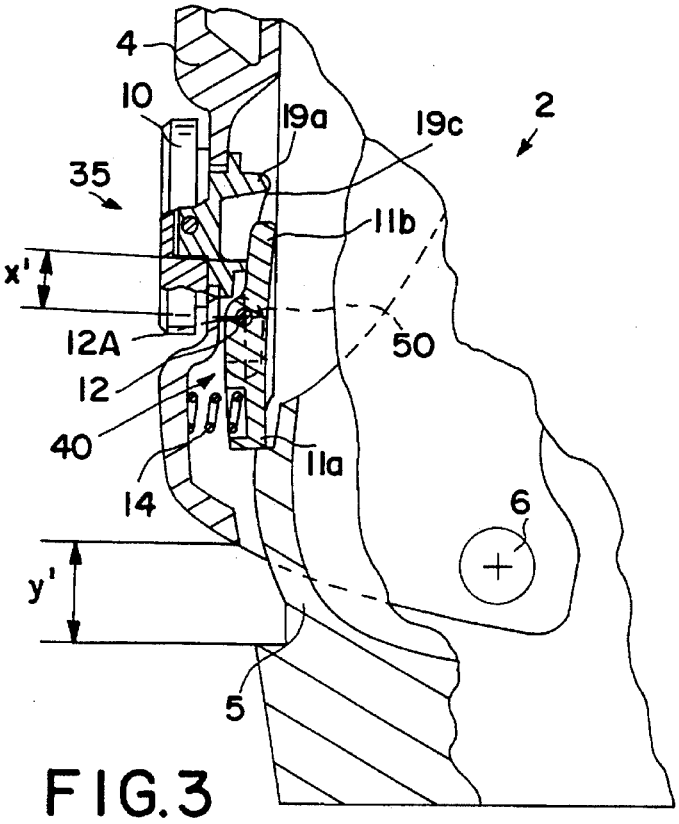

This locking/release device 35 is also illustrated in FIGS. 2 and 3.

Figure 4:
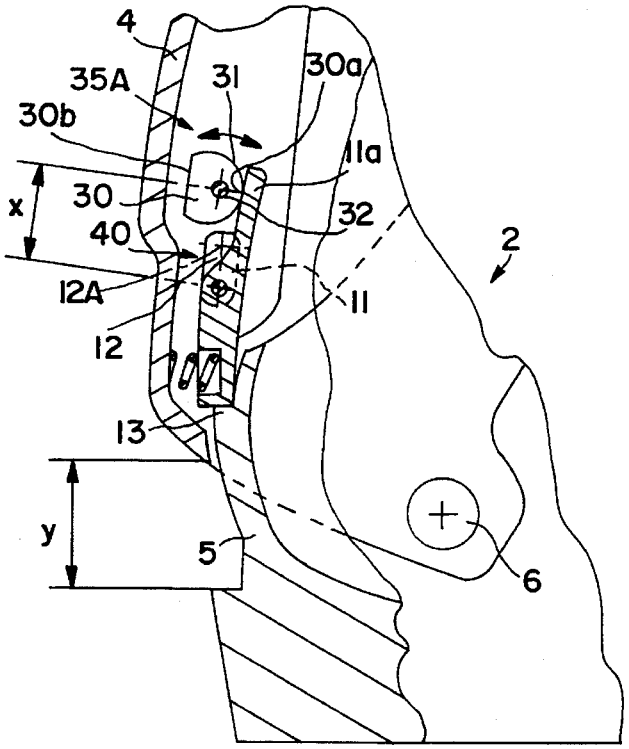
FIGS. 4 and 5 are cross-sections in partial side view of the boot comprising forward extension-adjustment means identical to those in the preceding figures, but whose locking/release-control device is different.
Figure 5:
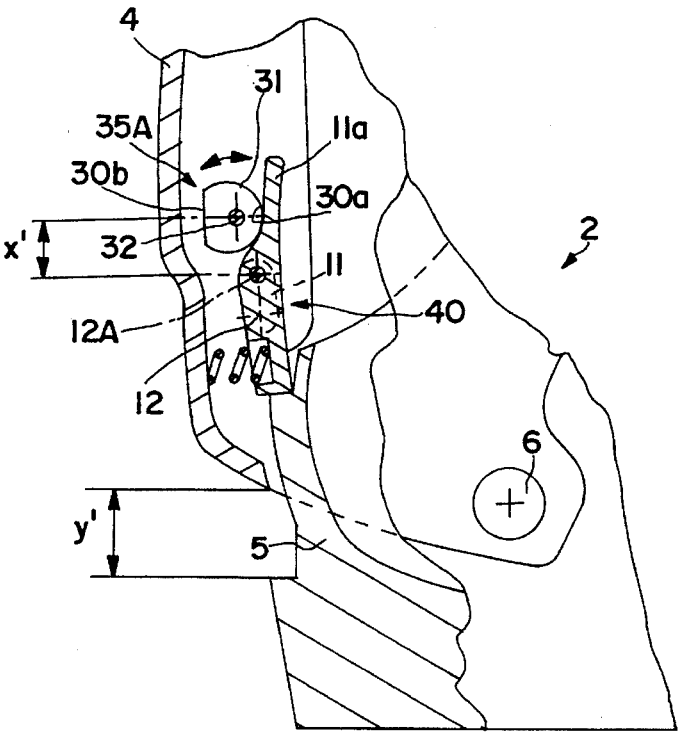

In the embodiment illustrated in FIGS. 4 and 5, the releasable locking device 35A differs basically from the preceding one by virtue of the fact that the control device (not shown) is accessible not from the rear, but on the side of the boot, and acts while rotating on a rotating cam 30 whose eccentric profile 31 can turn around a pin 32 when acted upon by a lateral control device. The cam 30 acts on the lever, or rocker, 11 between two positions: a locking position corresponding to an arrangement in which the end 11*b* of the lever 11 comes to be supported on a flat surface 30*a* of cam 30, at a predetermined distance from pin 32, and a release position (not shown), corresponding to the abutment 11*b* on another flat surface 30*b* of the same cam 30 opposite the flat surface 30*a* and at a distance from pin 32 that exceeds the distance separating the flat surface 30*a* from the same pin 32.

According to the invention, the initial forward extension position of the upper is adjusted using means 40 capable of modifying vertically the position of the hinge pin 12 of the rocker 11 in relation to the front portion 4 of the upper supporting it, in accordance with at least two adjustment values X, X' corresponding to a position 12A and a position 12B.

FIGS. 2 to 5 clearly show that the value X separating the pin 12 from the upper end 11*b* of the lever 11 corresponding to its position 12B is greater than the value X' separating the same pin 12, in its reversed position 12A, from this end 11*b*.

Consequently, and as shown especially well in FIGS. 2 to 5, the forward extension value Y separating the lower area 4*a* of the rear portion 4 of the upper 2 from the area 5*a* of the shell base 5 is greater than the distance Y' obtained after the hinge pin 12 (FIGS. 2 and 4) is returned from its position 12B to its position 12A (FIGS. 3 and 5).

More specifically, according to the embodiment shown in

FIGS. 1 to 9, the means for position adjustment 40 of the hinge pin 12 of the rocker 11 are constituted by two symmetrical elements 50 capable of being housed in corresponding stationary recesses 51 provided on either side of the inner faces 4*b* and outer faces 4*c*, respectively, of the rear portion 4 of the upper 2, these elements 50 supporting the ends of this hinge pin 12 in areas radially offset in relation to their stationary virtual center O, which merges with the center of their respective recess 51, so that rotation of these elements 50 around this virtual center O causes modification of the vertical position of the pin 12 in relation to the virtual center 0, and thus of the upper 2.

Figure 6:
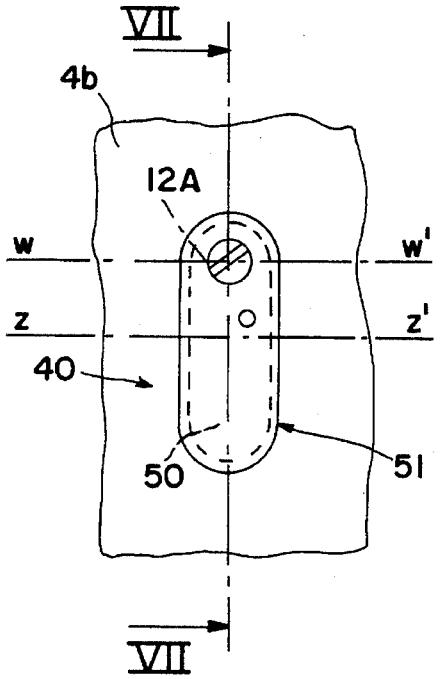
FIG. 6 is an enlarged plane view of the means for adjusting the upper to the minimum forward extension position, according to FIGS. 3 and 5.
Figure 7:
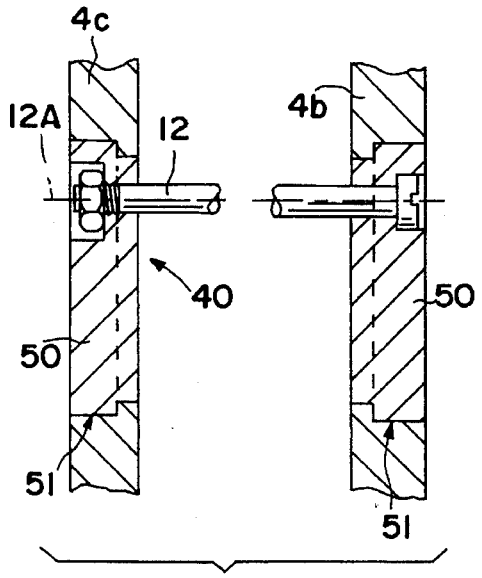
FIG. 7 is a cross-section along line VI—VI in FIG. 6.
Figure 8:
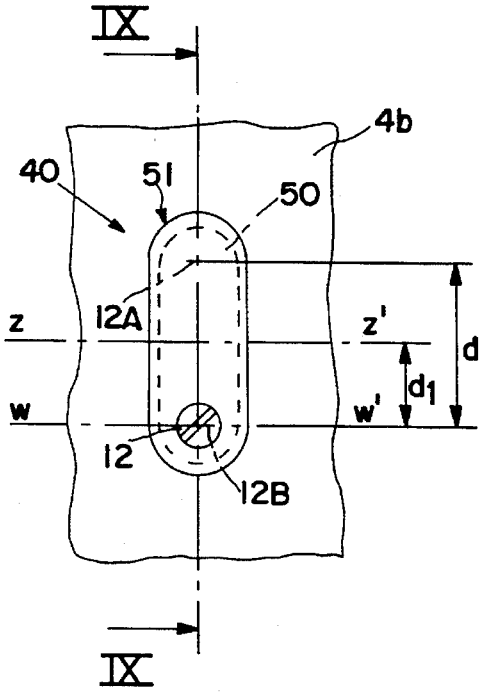
FIG. 8 is an enlarged plane view of the means for adjusting the upper to the maximum forward extension position, according to FIGS. 2 and 4.
Figure 9:
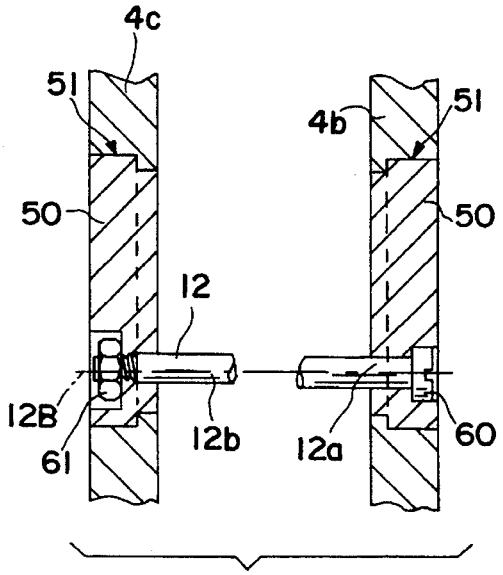
FIG. 9 is a cross-section along line IX—IX in FIG. 8.

According to the examples shown in FIGS. 1 to 9, and more specifically, in FIGS. 6 to 8, it can be seen that, when the pin 12 lying on the horizontal line W–W' (FIG. 6) moves from its position 12A for a new, opposite position 12B (FIG. 8), the distance "d" separating these two positions 12A–12B is equal to twice the distance "d1" separating line W–W' from the horizontal line Z–Z' passing through the virtual center O of the elements 50.

Moreover, as logic dictates, the aforementioned distance "d" is equal to the difference X–X' corresponding to the above-mentioned values separating the end 11*b* of the lever 11 from the pin 12, in its position 12A or 12B.

Furthermore, a mechanical connection from the hinge pin 12 to its support elements 50, and thus from the rear portion 4 of the upper 2, is effected by the pin 12 itself, 12*a* of which one end 12*a* comprises a head 60 that can be maneuvered in rotation and rests on one of the elements 50, and the other end 12*b* of which comprises a threaded part cooperating with a tightening nut 61 supported on the other element 50.

The head 60 of the pin 12 and/or of the nut 61 are embedded in their respective support elements 50.

In the present embodiment of the forward extension-adjustment mechanism, the support elements 50 belonging to the hinge pin 12 are oblong and have rounded ends. They could, of course, also be quadrilateral in shape.

Figure 10:
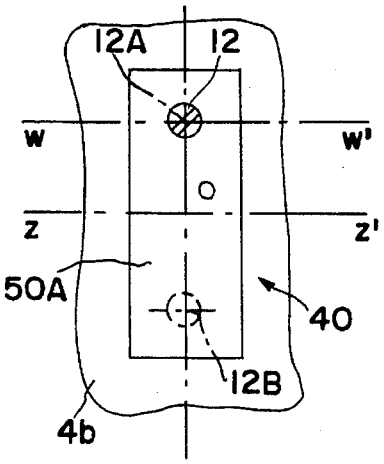
FIG. 10 is a plan view of the means for forward extension adjustment of the upper, according to a second embodiment.

Thus, for example, the second embodiment shown in FIG. 10 differs basically from the preceding embodiment by virtue of the fact that the support elements 50A are rectangular.

Figure 11:
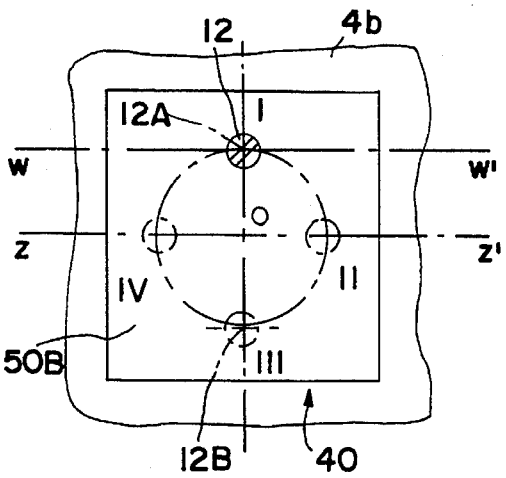
FIG. 11 is a plane view of the means for forward extension adjustment of the upper, according to a third embodiment.

According to a third embodiment, shown in FIG. 11, the support elements 50B associated with the hinge pin 12 are square, so as to allow vertical adjustment of this hinge pin between four positions I, II, III, IV by successive rotations at an angle of 90° around their virtual center O.

According to the first and second cases mentioned above, the support elements 50, 50A of the hinge pin 12 are rotationally reversible on themselves at an angle of 180° around their virtual center O, in order to allow vertical adjustment of the hinge pin 12 between two end positions.

Figure 12:
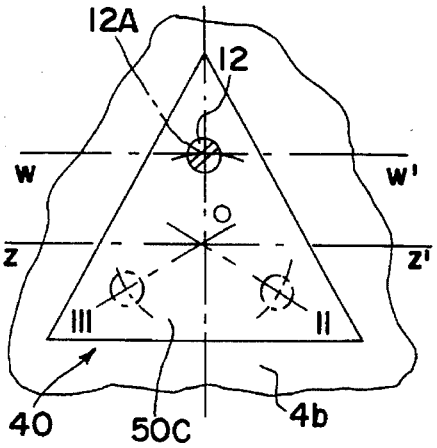
FIG. 12 is a plane view of the means for forward extension adjustment of the upper, according to a fourth embodiment.

According to a fourth variant shown in FIG. 12, the support elements 50C have the shape of an equilatereal triangle, so as to be able to move between three positions I, II, III by rotation of 120° around the virtual center O, positions II and III being offset in relation to the upper 2 but at the same level in relation to the vertical.

Figure 13:
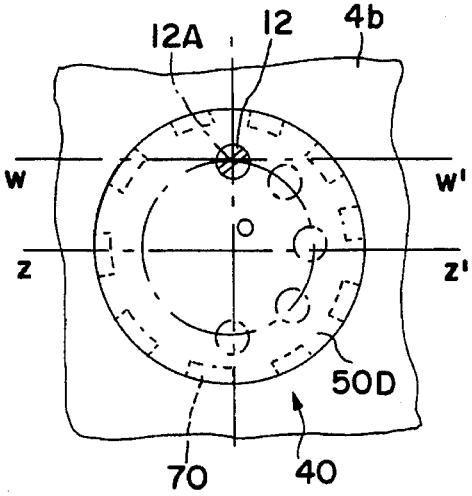
FIG. 13 is a plane view of the means for forward extension adjustment of the upper, according to a fifth embodiment.

According to a fifth embodiment illustrated in FIG. 13, the support elements 50D associated with the hinge pin 12 are circular, so as to allow vertical multiple-position adjustment I, II, III, etc. of the hinge pin around their virtual center O, and which comprise means for arresting rotation after adjustment.

The means for arresting rotation of the circular support elements 50D are constituted by radial teeth 70 arranged peripherally on the face of the elements 50D in relation to their virtual center O and cooperating with at least one corresponding notch cut in a corresponding area of the bottom of the recesses in these elements 50D.

Figure 14:
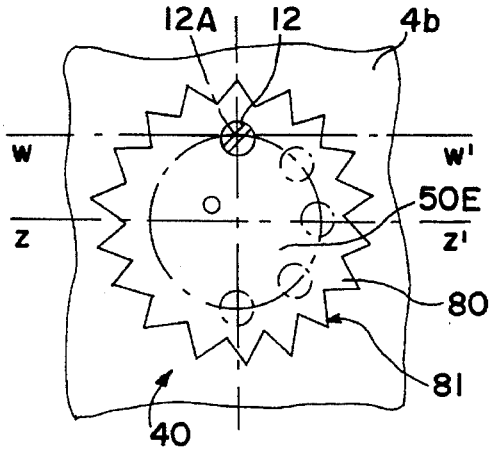
FIG. 14 is a plane view of the means for forward extension adjustment of the upper, according to a sixth embodiment.

A sixth variant illustrated in FIG. 14 differs basically from the preceding one by virtue of the fact that the means for locking the circular support elements 50E in position are constituted by peripheral teeth 80 provided on elements 50E and cooperating with corresponding notches 81 in the recesses in the elements 50E.

In all of the preceding embodiments, the position of the hinge pin belonging to the lever, or rocker, 11 is changed by loosening the nut 61 and by rotating the head of the screw 60 using a suitable tool, enough to make it possible to remove the support elements 50 to 50E from their respective recesses; then, after moving the upper forward to the desired position, the screw-nut assembly 60, 61 is retightened.

What is claimed is:

1. Alpine ski boot comprising a shell base (5) surmounted by an upper (2) having a front portion (3) and a rear portion (4) made of at least one piece, said rear portion (4) of said upper (2) pivoting at least partially and comprising a device (35) for releasably locking said upper (2) in relation to said shell base (5), which is constituted by a stop zone (13) provided on said shell base (5) and by a pivoting lever (11) forming a rocker device jointed to a horizontal pin (12) on said rear portion (4) of said upper (2) perpendicularly to its medial vertical plane and capable of locking said upper in position by cooperating with said stop (13) when acted upon by a control device (10) accessible from the outside of the boot and acting in opposition to a return spring (14) associated with said lever (11), the locked position of said lever corresponding to an initial adjustable forward extension reference position from which said upper (2) can pivot angularly in relation to said shell base (5) at a predetermined amplitude, wherein the initial forward extension position of said upper (2) is adjusted using means (40) capable of modifying vertically the position of said hinge pin (12) of said rocker (11) in relation to said rear portion (4) of said upper (2) which supports it, according to at least first and second adjustment values determining respective first and second positions.

2. Boot according to claim 1, wherein said means (40) for position adjustment of said hinge pin (12) of said rocker (11) are constituted by two symmetrical support elements (50, 50A to 50E) capable of being housed in corresponding stationary recesses (51) provided on either side of inner faces 4*b* and outer faces 4*c*, respectively, of said rear portion (4) of said upper (2), said support elements (50, 50A to 50E) each having a virtual center (O) and supporting ends of said hinge pin (12) in areas offset radially of said respective virtual center (O), said virtual center merging with the center of respective said recesses (51) in such a way that rotation of said support elements (50, 5A to 50E) around said virtual center (O) causes modification of the vertical position of said pin (12) relative to said virtual center (O), and thus of said upper (2) relative to said shell base (5).

3. Boot according to claim 2, wherein said support elements (50D, 50E) of said hinge pin (12) are circular, so as to allow vertical multiple-position adjustment (I, I, III, etc.) of said hinge pin around their virtual center (O) and comprising means for arresting rotation after adjustment.

4. Boot according to claim 2, wherein said support elements (50A, 50B) of said hinge pin have an overall quadrilateral shape.

5. Boot according to claim 4, wherein said support elements (50B) of said hinge pin (12) are square, so as to allow vertical adjustment of said hinge pin between four positions (I, II, III, IV) by successive rotations at an angle of 90° around their virtual center (O).

6. Boot according to claim 4, wherein said support elements (50) of said hinge pin (12) are oblong and have rounded edges.

7. Boot according to claim 4, wherein said support elements (50, 50A) of said hinge pin (12) are rotationally reversible on themselves at an angle of 180° around their virtual center (O), so as to allow vertical adjustment of said hinge pin (12) between two end positions (12A, 12B).

8. Boot according to claim 1, wherein a mechanical link from said hinge pin (12) to its support elements (50, 50A to 50E), and thus from said rear portion (4) of said upper (2), is effected by said pin (12) itself, of which one end (12*a*) comprises a head (60) that can be rotated and that is supported on one of the elements (50, 50A to 50E), and of which the other end (12*b*) comprises a threaded part cooperating with a tightening nut (61) resting on the other element (50, 50A to 50E).

9. Boot according to claim 8, wherein the head (60) of said pin (12) and of said nut (61) are embedded in their respective support elements (50, 50A, 50E).

10. Boot according to claim 3, wherein said means (70, 80) for arresting rotation of said circular support elements (50E) are constituted by peripheral teeth (80) provided on said elements (50E) and enagaging with corresponding notches (81) provided in the recesses of said support elements (50E).

11. Boot according to claim 3, wherein said means for locking said circular support elements (50D) in position are constituted by radial teeth (70) produced on said elements (50D) in relation to their virtual center (O) and engaging with at least one corresponding notch cut in a corresponding area of the bottom of the recesses of said support elements (50D).

* * * * *